US010808437B2

(12) United States Patent
Brickner

(10) Patent No.: US 10,808,437 B2
(45) Date of Patent: Oct. 20, 2020

(54) MOTOR VEHICLE DOOR LATCH WITH PRIMARY AND SECONDARY PAWL

(71) Applicant: Kiekert AG, Heiligenhaus (DE)

(72) Inventor: Robert L. Brickner, Berkley, MI (US)

(73) Assignee: Kiekert AG, Heiligenhaus (DE)

( * ) Notice: Subject to any disclaimer, the term of this patent is extended or adjusted under 35 U.S.C. 154(b) by 434 days.

(21) Appl. No.: 15/656,041

(22) Filed: Jul. 21, 2017

(65) Prior Publication Data

US 2019/0024424 A1 Jan. 24, 2019

(51) Int. Cl.
*E05B 85/26* (2014.01)
*E05B 77/02* (2014.01)
(Continued)

(52) U.S. Cl.
CPC ..... *E05B 85/26* (2013.01); *E05B 77/02* (2013.01); *E05B 77/04* (2013.01); *E05B 85/243* (2013.01);
(Continued)

(58) Field of Classification Search
CPC ..... Y10T 292/1047; Y10T 292/1082; Y10T 292/108; Y10T 292/0908; E05B 85/26;
(Continued)

(56) References Cited

U.S. PATENT DOCUMENTS 3,905,627 A * 9/1975 Fujita ..... E05B 77/265 292/216
4,203,621 A * 5/1980 Noel ..... E05B 85/26 292/216
(Continued)

FOREIGN PATENT DOCUMENTS

DE 2403238 8/1974
DE 2839071 A1 9/1979
(Continued)

OTHER PUBLICATIONS

International Search Report and Written Opinion completed on Oct. 22, 2018 for PCT/IB2018/000750.

*Primary Examiner* — Mark A Williams

(74) *Attorney, Agent, or Firm* — Renner, Otto, Boisselle & Sklar, LLP

(57) ABSTRACT

The invention relates to a latch for a door or flap of a motor vehicle with a locking mechanism comprising a catch (3), a primary pawl (1) for ratcheting with the catch (3) in a main ratchet position and a separate secondary pawl (2) for ratcheting with the catch (3) in a pre-ratchet position, whereby only in the case of overload can the secondary pawl (2) additionally ratchet to the primary pawl (1) with the catch (3) in the main ratchet position. The invention furthermore relates to a latch for a door or a flap of a motor vehicle with a locking mechanism comprising a catch (3) with a load arm (7) and a catching arm (8) a primary pawl (1) to ratchet with the load arm (7) of the catch (3) in a main ratchet position and a separate secondary pawl (2) to ratchet with the catching arm (8) of the catch (3) in a pre-ratchet position, whereby the catch (3), the primary pawl (1) and the secondary pawl (2) are arranged on the same plane. A reduction of the complexity, e.g. an automatic closure aid and increased stability, i.e. the tensile strength are enabled simultaneously.

13 Claims, 1 Drawing Sheet

(51) Int. Cl.

| | |
|---|---|
| ***E05B 77/04*** | (2014.01) |
| ***E05B 85/24*** | (2014.01) |
| *E05B 83/18* | (2014.01) |
| *E05B 83/36* | (2014.01) |

(52) U.S. Cl.
CPC ..... *E05B 83/18* (2013.01); *E05B 83/36* (2013.01); *E05Y 2900/531* (2013.01); *E05Y 2900/548* (2013.01)

(58) Field of Classification Search
CPC ..... E05B 81/14; E05B 77/06; E05B 77/02; Y10S 292/23
See application file for complete search history.

(56) References Cited

U.S. PATENT DOCUMENTS 4,263,574 A 4/1981 Mori et al.
4,835,997 A * 6/1989 Akright ..... E05B 65/0811 292/216
5,979,951 A * 11/1999 Shimura ..... E05B 85/26 292/216
2005/0218661 A1* 10/2005 Brose ..... E05B 81/06 292/216
2010/0052336 A1 3/2010 Bendel et al.
2011/0169280 A1* 7/2011 Scholz ..... E05B 85/26 292/200
2011/0169282 A1* 7/2011 Scholz ..... E05B 85/26 292/220
2011/0204660 A1* 8/2011 Cumbo ..... E05B 85/243 292/217
2011/0210565 A1* 9/2011 Scholz ..... E05B 85/26 292/200
2014/0091581 A1* 4/2014 Taurasi ..... E05B 15/04 292/215
2014/0291998 A1* 10/2014 Pettengill ..... E05B 85/00 292/96
2018/0080266 A1 3/2018 Lebsak

FOREIGN PATENT DOCUMENTS

DE 19902561 A1 8/2000
DE 10 2007 003 948 A1 5/2008
DE 202012003397 7/2013
DE 202017000456 2/2017
EP 1512815 3/2005
GB 2334297 8/1999
WO 2014155177 10/2014

* cited by examiner

MOTOR VEHICLE DOOR LATCH WITH PRIMARY AND SECONDARY PAWL

The invention relates to a latch for a door or flap of a motor vehicle with a locking mechanism comprising a catch, a primary pawl for ratcheting with the catch in a main ratchet position and a separate secondary pawl for ratcheting with the catch in a pre-ratchet position.

BACKGROUND

For motor vehicle latches, high stability is demanded so that even when great forces act on the door or flap, for example by misuse or in the event of a crash, no unscheduled opening occurs.

With increasing automation in the automotive field for provision of greater operating convenience, motorized closure aids are increasingly used for bringing a door or flap into the scheduled closed position by means of motor power.

However, such closure aids are of a comparatively complex construction in order to execute the necessary pulling distance into the closed position, i.e. into the main ratchet position of the catch. The complex construction increases the construction weight which must be saved elsewhere without reducing the stability mentioned at the start.

Publications DE102007003948A1, DE2839070A1 and DE19902561A1 reveal latches for a door or a flap of a motor vehicle with a locking mechanism comprising a catch and at least a pawl.

SUMMARY

Unless specified otherwise hereafter, the aforementioned characteristics of a locking mechanism can be part of the invention individually or in combination.

In view of what has been explained above, it is the task of the invention to provide a further developed latch of the type stated at the beginning.

The task of the invention is solved by a latch with the characteristics of claim 1 and the sub-claim. Advantageous designs arise from the sub claims.

A latch for a door or flap of a motor vehicle with a locking mechanism comprising a catch, a primary pawl for ratcheting with the catch in a main ratchet position and a separate secondary pawl for ratcheting with the catch in a pre-ratchet position solves the task, whereby only in the case of overload the secondary pawl in addition to the primary pawl can ratchet with the catch in the main ratchet position.

The door is generally a side door. The flap is usually the trunk or the tailgate. However, the flap can also be the motor hood.

Locking mechanism means a usual locking mechanism of a latch for a door or a flap of a motor vehicle, the preferred construction and functionality of which is explained in detail further below.

A primary and separate secondary pawl are two separate components. Two separate components can normally be moved independently of one another. Compared to a normal load, overload means an increased load. Load means a force which acts on a catch in the main ratchet position in the opening direction. In particular, the load or force is transferred from a locking bolt incorporated to the catch and can arise, for example, by a pulling of the door or flap.

Overload predominates especially if a gap is closed between the secondary pawl and the catch by the overload, whereby the same gap is distanced in operation for a normal load and the secondary pawl is distanced from the catch—in particular from the collecting arm of the catch.

In the case of a closed gap, the secondary pawl touches the catch directly. Consequently, the catch can brace against the overload or force of the overload on the secondary pawl.

In other words, an overload predominates especially if an elastic deformation of the catch and/or the primary pawl leads to closure of the gap between the secondary pawl and the catch, whereby the same gap in operation with a normal load maintains the secondary pawl at a distance from the catch.

By means of a latch for a door or flap of a motor vehicle with a locking mechanism comprising a catch, a primary pawl for ratcheting with the catch in a main ratchet position and a separate secondary pawl for ratcheting with the catch in a pre-ratchet position, whereby only in the case of overload does the secondary pawl, in addition to the primary pawl, ratchet with the catch in the main ratchet position, enabling both a reduction of the complexity of an automatic closure aid and increased stability, for example of the tensile strength.

The reduction of the complexity is specifically caused by the fact that the provision of the separate secondary pawl means that the rotary path of the catch from the pre-ratchet position into the main ratchet position can be reduced. If, for example, a closure aid should be implemented which in particular executes motorized rotation of the catch from the pre-ratchet position to the main ratchet position, a simple and compact mechanism with a comparatively light weight can already be sufficient. The increase of the construction weight of the latch by the implementation of a closure aid can thus be kept low.

At the same time, as a result of the increased stability weight can be saved on the catch and the pawl to fulfill safety requirements nevertheless. Because due to the additional ratcheting of the secondary pawl with the catch in the main ratchet position during overload, the load is distributed on the primary and secondary pawl and relieves the primary pawl in particular.

A locking mechanism generally encompasses a catch to incorporate a locking bolt and a pawl to hold the catch with the incorporated locking bolt in the closed state of the locking mechanism. In principle, a locking mechanism is set up in such a way that, due to scheduled activation of the locking mechanism by the user, the pawl is disengaged from the catch. Consequently, the catch can release the locking bolt again.

The motor vehicle latch preferably encompasses a latch plate made of metal or a metallic latch case with the latch plate, whereby the locking mechanism is accommodated with the catch and the pawl on the latch plate or in the latch case. The latch plate usually demonstrates an inlet slot which allows the locking bolt to reach the latch in order to be incorporated by the rotatable catch of the locking mechanism and to be held by ratcheting of the pawl with the catch. Either the locking bolt is attached to the vehicle chassis and the latch plate or latch case is attached to the door or flap or vice versa.

The catch of a motor vehicle latch normally has a load arm and a collecting arm which jointly form a fork-shaped inlet slot of the catch into which the locking bolt goes especially when passing the inlet slot of the latch plate when the door or flap is closed. The locking bolt then rotates the catch from an open position in the direction of the closed position. If the catch has reached the closed position, it is ratcheted in this position via the pawl. The locking bolt can then no longer leave the inlet slot of the catch. This ratchet position is called a main ratchet position.

In particular, the locking mechanism demonstrates a second ratcheting position, namely the so-called pre-ratchet position. The pre-ratchet position serves to retain the door or flap for safety reasons if this does not reach the main ratchet position during closure. In the pre-ratchet position the catch is consequently not completely closed. However, an opening movement of the catch by the pawl is already prevented. In the main ratchet position, the catch and thus the locking mechanism is completely closed. The pre-ratchet thus constitutes a transitional state between the open position and the closed position or main ratchet position.

Ratcheting of the catch by the pawl in the main ratchet position or the pre-ratchet position generally occurs via corresponding main ratchet surfaces or pre-ratchet surfaces which are adjacent to one another in the main ratchet position or pre-ratchet position in order to retain the catch in the main ratchet position or the pre-ratchet position.

In particular, the locking mechanism has a blocking lever in addition to the pawl to retain the pawl in the main ratchet position in order to generally reduce the background noise when the motor vehicle door is closed and to reduce the necessary activation force for triggering, i.e. disengaging or opening, the locking mechanism. For a locking mechanism thus created, the relative position between the catch and the pawl is in principle formed in such a way that a force acting from the catch onto the pawl in the opening direction induces an opening torque into the pawl favoring the release or disengagement of the catch instead of fastening of the catch.

The blocking lever thus serves to fasten the pawl in the position ratcheted with the catch. For example, the force in the opening direction which acts from the catch onto the pawl is generated by compression of a rubber seal of the door or flap. An opening moment constantly acts on the pawl in this case in the closed position. To trigger the locking mechanism, a disengagement of the fastening between the blocking lever and the pawl is then sufficient so that the pawl releases the catch and the locking mechanism can open. Opening of the latch is thus possible with especially little expenditure of force.

In one design form, in the case of normal loads a gap distances the secondary pawl from the catch in an opening direction of the catch, when the catch is in the main ratchet position. The secondary pawl is therefore arranged in the main ratchet position of the catch in the opening direction of the catch and separated from the catch by the gap.

The opening direction is the direction in which the catch rotates in order to get from the main ratchet position in the closed position of the locking mechanism into the opening position. Normal load is a load smaller than the overload.

A ratcheting of the secondary pawl with the catch in the main ratchet position is enabled in addition to the primary pawl by means of the gap in the case of overload. Consequently, in the case of overload a load division can occur between the primary and secondary pawl and in the case of normal loads in contrast an especially simple triggering of the locking mechanism. Additionally, an overdefinition of ratchet connections and thus an especially reproducible and reliable ratcheting is enabled in the main ratchet position for normal loads.

In one design form, in the case of overload a deformation of the catch and/or primary pawl leads to closure of the gap. Closure of the gap means that the secondary pawl comes into direct contact with the catch, i.e. in contact with the catch. Consequently, the catch can be braced on the secondary pawl against the overload or force of the overload. A self-controlling mechanism can thus be facilitated to distribute the load in the case of an overload.

In one design form, the deformation of the catch and/or the primary pawl is an elastic deformation. After the occurrence of an overload, the locking mechanism thus requires no repair or maintenance measure to continue to function properly. When overloaded, the catch and/or primary pawl are therefore so greatly deformed that the catch is pressed against the secondary pawl when the gap is closed and can thus be braced on the secondary pawl. With normal loads, the catch and/or the primary pawl are not deformed or only slightly deformed. Consequently, the catch is pressed in the direction of the secondary pawl. However, the gap between the catch and secondary pawl remains open.

In the case of scheduled opening of the locking mechanism, the gap distances the secondary pawl from the catch in the main ratchet position especially such that no frictional force occurs between the secondary pawl and the catch to trigger the locking mechanism from the main ratchet position or needs to be overcome to open the locking mechanism.

In one design form, an opening moment is induced into the primary pawl and/or the locking mechanism demonstrates a blocking lever to block the primary pawl in the ratcheted state with the catch in the main ratchet position in the case of a load acting on the catch in an opening direction. By means of the primary pawl with an opening moment and/or the provision of a blocking lever as described above, an especially great convenience can be provided to the user.

In one design form, the catch, the primary pawl and the secondary pawl are arranged on the same plane. Arranged on the same plane means that the catch, the primary pawl and the secondary pawl are pivotably accommodated on a common rotational plane, i.e. are therefore not arranged in different rotational planes. In other words, the catch, the primary pawl and the secondary pawl all mutually overlap if viewed transverse to the catch rotational axis. In particular, the catch rotational axis, the primary pawl pivoting axis and the secondary pawl pivoting axis are all arranged in parallel to one another. An especially compact design with an especially light weight can thus be enabled.

In one design form, the blocking lever is arranged on the same plane as the catch, the primary pawl and the secondary pawl. An especially compact design with an especially light weight can thus be enabled.

In one design form, a triggering lever of the locking mechanism acts simultaneously on the blocking lever and the secondary pawl in order to be able to disengage the locking mechanism both from the pre-ratchet position and the main ratchet position to open the latch by the same triggering lever. If the triggering lever is activated to open the latch, both blocking of the primary pawl by the blocking lever in the main ratchet position of the catch and also ratcheting of the catch in the pre-ratchet position by the secondary pawl can thus be disengaged. An additional triggering lever and thus additional weight can be saved and the mechanics can be executed with particular ease.

In one design form, the blocking lever is provided by a blocking lever section of the secondary pawl, the blocking lever and the secondary pawl are one and the same component and/or the blocking lever and the secondary pawl are formed as a single part or component. Thus, there is no need to provide an additional lever for this functionality needs and the number of components and weight can accordingly be reduced. The blocking lever section assists the stability of the secondary pawl, so to speak, due to its volume.

In one design form, the catch and the secondary pawl are formed and arranged in such a way that when the catch rotates from an open position in the direction of the main ratchet position, the secondary pawl is pivoted after passing the pre-ratchet position by the catch in such a way—especially away from the catch—that the blocking lever section—in particular due to a free-lifting recess—enables blockade-free pivoting out of the primary pawl to ratchet with the catch in the main ratchet position.

Pivoting out to ratchet with the catch means a snapping movement as for a drop-latch, i.e. the primary pawl is initially pivoted outwards as a result of displacement by the external contour of the catch in order to pivot back in the direction of the catch again after overcoming a radial protrusion of the catch in order to ratchet on the other side with the protrusion. Consequently, the catch can no longer rotate into the opposite direction, i.e. no longer in the opening direction. Reliable ratcheting, saving of additional levers and additional weight, can thus be guaranteed.

In a further design form, the primary pawl locks the secondary pawl in the blockade-free pivoted out position—preferably by adjacency or gliding on the free lift recess of the blockade lever section—such that the blockade lever section is prevented during the blockade-free pivoting out of the primary pawl from pivoting (back) into the blockade position to block the primary pawl. Reliable ratcheting, saving additional levers and additional weight, can thus be guaranteed.

In one design form, only the secondary pawl can ratchet the catch in the pre-ratchet position. An especially short rotational path of the catch from the pre-ratchet position into the main ratchet position can thus be achieved.

In one design form, the locking mechanism is set up in such a way that the primary pawl and the secondary pawl can respectively only ratchet with the same arm of the catch, i.e. either the load arm or the collecting arm. The secondary pawl can therefore only ratchet with the collecting arm, for example, in the pre-ratchet position and in the main ratchet position. Ratcheting of the secondary pawl with the load arm is not possible according to this design form. This applies analogously to the primary pawl, whereby the primary pawl can preferably only ratchet with the catch in the main ratchet position.

An especially short rotational path of the catch from the pre-ratchet position into the main ratchet position can thus be provided in particular with an arrangement of the catch, the primary pawl and the secondary pawl in the same plane.

In one design form, the locking mechanism is set up in such a way that the primary pawl and the secondary pawl can only ratchet with different arms of the catch, i.e. either the load arm or the collecting arm. The primary pawl and the secondary pawl can therefore not both ratchet with the load arm, especially not in the pre-ratchet position and also not in the main ratchet position of the catch. For example, regardless of the pre-ratchet or main ratchet, the secondary pawl can only ratchet with the collecting arm, for example and the primary pawl can only ratchet with the load arm, whereby the primary pawl can preferably only ratchet with the catch in the main ratchet position.

An especially short rotational path of the catch from the pre-ratchet position into the main ratchet position can thus be executed in particular with an arrangement of the catch, the primary pawl and the secondary pawl in the same plane.

In one design form, the locking mechanism is set up in such a way that the primary pawl can ratchet with the load arm and the secondary pawl can ratchet with the collecting arm. An especially short rotational path of the catch from the pre-ratchet position into the main ratchet position can thus be executed in particular with an arrangement of the catch, the primary pawl and the secondary pawl in the same plane in this design form too.

A further aspect of the invention to solve the task stated at the beginning relates to a latch for a door or a flap of a motor vehicle with a locking mechanism comprising a catch with a load arm and a collecting arm, a primary pawl to ratchet with the load arm of the catch in a main ratchet position and a separate secondary pawl to ratchet with the collecting arm of the catch in a pre-ratchet position, whereby the catch, the primary pawl and the secondary pawl are arranged on the same plane. Due to the further aspect of the invention, a reduction of the complexity of an automatic closure aid and increased stability, i.e. of the tensile strength, are simultaneously enabled.

The explanations and design forms of the solution of the task described at the start also apply identically to the further aspect of the invention.

Design examples of the invention are explained in further detail hereafter on the basis of figures. Characteristics of the design examples can be combined individually or plurally with the claimed objects.

BRIEF DESCRIPTION OF THE DRAWINGS

The following are shown.

DETAILED DESCRIPTION

Figure 1:
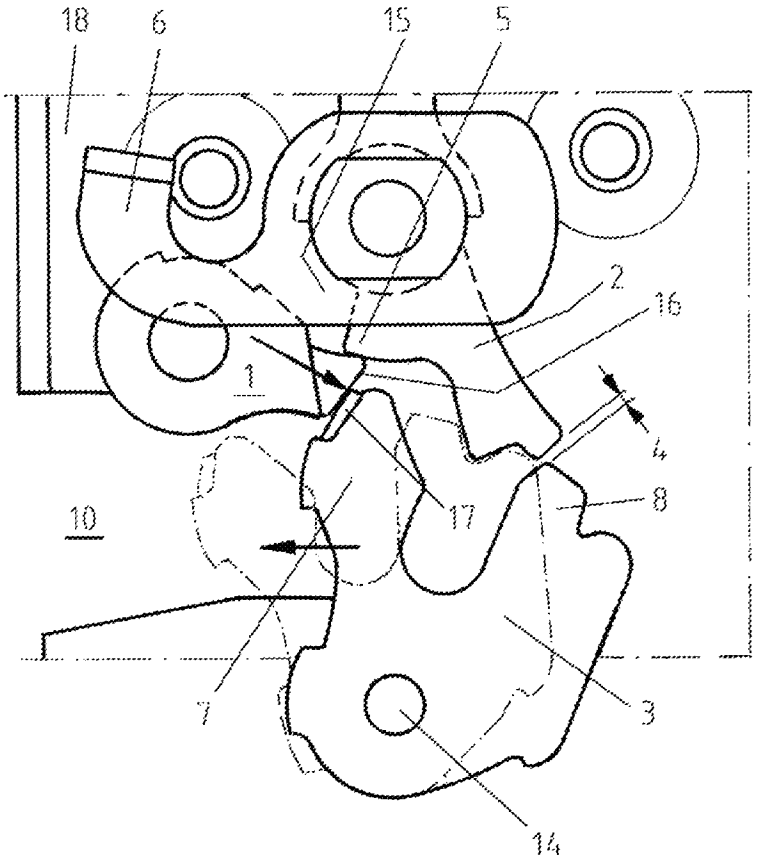
FIG. 1: Diagrammatic depiction of a latch for a door or flap of a motor vehicle with a locking mechanism in the closed position with a normal load, i.e. with the catch in the main ratchet position and additionally also depicted in dashes the pre-ratchet position of the catch.

FIG. 1 shows a locking mechanism in a closed position. The primary pawl 1 is ratcheted with the catch 3 in the main ratchet position and is blocked by the blockade lever section 5 of the secondary pawl 2 in this ratcheted position or this ratcheted state. The normal load is depicted by a horizontal arrow in the opening direction. A gap 4 distances the secondary pawl 2 from the catch 3 in the opening direction of the catch 3. The catch 3, the primary pawl 1 and the secondary pawl 2 and the blockade lever section 5 are arranged on the same plane. The primary pawl is illustrated with the load arm 7 of the catch 3 ratcheted in the main ratchet position.

The pre-ratchet position of the catch 3 is depicted in dashes, whereby the secondary pawl 2 is illustrated with the collecting arm 8 of the catch 3 ratcheted in the pre-ratchet position. The position of the secondary pawl 2 in the ratcheted state with the catch 3 in the pre-ratchet position precisely or roughly preferably corresponds to the position in which the blockade lever section 5 blocks the primary pawl 1 in the ratcheted state with the catch 3 in the main ratchet position, in order to facilitate mechanics of an especially simple construction. This blockade position can also be provided slightly displaced in a rotated manner, especially in a clockwise direction in order to guarantee reliable ratcheting in the case of overload. If the catch 3 is in the pre-ratchet position, the primary pawl 1 can preferably be adjacent on the load arm 7 on the side of the inlet slot 9 of the catch 3, i.e. not as illustrated in FIG. 1.

The difference of the rotational positions of the catch 3 in the pre-ratchet position and the main ratchet position results in the rotational path. Compared to a locking mechanism with only one pawl, which is consequently provided for ratcheting with the catch in the pre-ratchet position and in the main ratchet position, an especially small rotational path is enabled.

Figure 2:
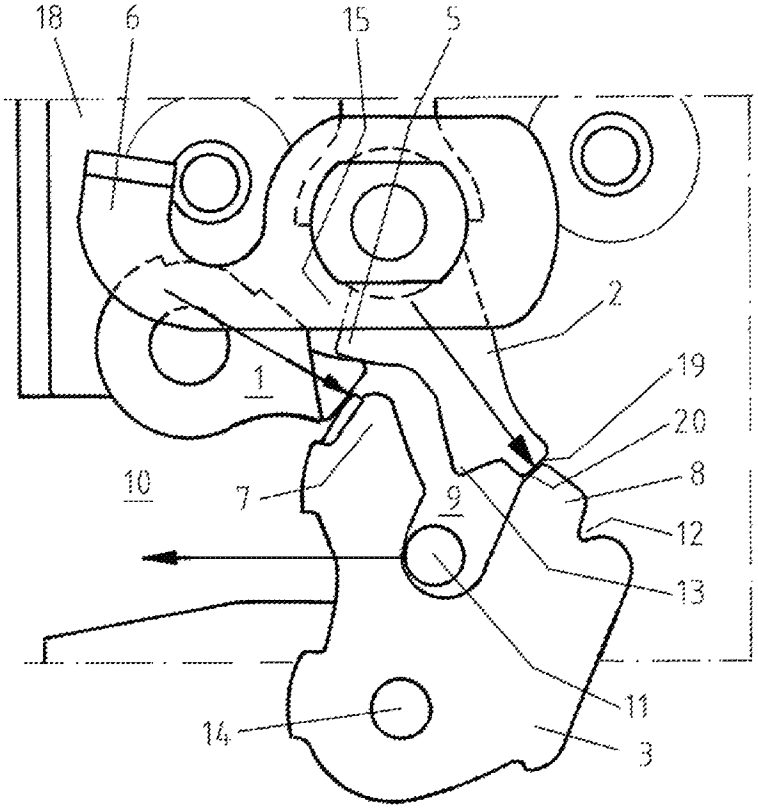
FIG. 2: Diagrammatic depiction of a latch for a door or a flap of a motor vehicle with a locking mechanism in the closed position in the case of an overload.

FIG. 2 shows the locking mechanism of FIG. 1 in the case of an overload which is transferred from the locking bolt 11 onto the catch 3. The primary pawl 1 and/or the catch 3 deform under the overload. Consequently, the gap 4 closes and the secondary pawl also ratchets with the catch 3, namely with the collecting arm 8. The load is thus distributed onto the primary pawl 1 and the secondary pawl 2.

A closure process and opening process can occur as described hereafter. The locking bolt 11 encounters the collecting arm 8 of the catch 3 in the opening position and rotates the catch against a non-illustrated catch spring in the direction of the closed position, i.e. the main ratchet position. In particular, the primary pawl 1 and/or the secondary pawl 2 demonstrate non-illustrated torsion springs with a spring pre-tensioning into the opposite torsional direction as the catch spring. The primary pawl 1 is thus displaced outwards or pivoted outwards by the side of the collecting arm 8 deflected from the inlet slot 9 of the catch 3. However, the ratchet surface of the primary pawl 1 on the free end of the primary pawl 1 is formed in such a way that ratcheting with a ratchet surface of the collecting arm 8 is not possible on the free end of the collecting arm 8.

In one design form, the maximum radius of the collecting arm 8 is smaller than the maximum radius of the load arm 7. The primary pawl can thus pass the collecting arm 8, even if the blockade lever section 5 is located in the blockade position or at least in a blocking position for the primary pawl 1 in the ratcheted state with the catch 3 in the main ratchet position.

After the collecting arm 8 has passed the primary pawl 1, the collecting arm 8 displaces the secondary pawl 2 outwards or deflects the secondary pawl 2. In particular, the ratchet surface or pre-ratchet ratchet contour 12 of the collecting arm 8 viewed in the direction of the catch rotational axis 14 has in particular the shape of a recess, in particular a V-shaped recess centrally on the free end of the collecting arm 8. A corresponding pre-ratchet contour 13 of the secondary pawl 2 engages into this pre-ratchet contour 12 and thus retains the catch 3 in the pre-ratchet position if the load exerted on the catch 3 decreases after passing the pre-ratchet position and before reaching the main ratchet position and the catch 3 would otherwise rotate beyond the pre-ratchet position back in the opening direction. With an ongoing load, however, the pre-ratchet contour 12 of the collecting arm 8 also displaces the pre-ratchet contour 13 of the secondary pawl 2. Consequently, the secondary pawl 2 pivots out and the catch 3 is passed in the direction of the closed position.

After the catch 3 has passed the pre-ratchet position during rotation in the direction of the main ratchet position, the circumferential contour displaces the catch 3 the secondary pawl 2 in particular in such a way outwards that the blockade lever section 5 of the secondary pawl 2 preferably enables the primary pawl 1 blockade-free pivoting out by means of a free-lifting recess 15, when the primary pawl 1 encounters the load arm 7 and for ratcheting—or better snapping in—is displaced outwards and pivoted out in order to engage into the envisaged ratchet position with the catch 3 in the main ratchet position after overcoming the circumferential area with the maximum radius of the load arm. The main ratchet contour 16 of the primary pawl 1 is then adjacent on the main ratchet contour 17 of the load arm 7.

The gap 4 extends from the overload main ratchet contour 20 of the catch 3 to the overload main ratchet contour 19 of the secondary pawl 2. In the case of overload, the gap 4 is closed and the overload main ratchet contour 19 of the secondary pawl 2 engages into the overload main ratchet contour 20 of the catch 3 or ratchets with it.

With the pivoting out of the primary pawl 1 for the snapping movement the free end of the primary pawl 1, especially an area of the main ratchet contour 16 of the primary pawl 1, goes into the free-lifting recess of the blockade lever section 5 in such a way that the blockade lever section 5 and thus the secondary pawl 2 are prevented during blockade-free pivoting out of the primary pawl 1 from pivoting back into the blockade position to block the primary pawl. Only after engagement of the primary pawl 1 into the catch 3 in the main ratchet position does this prevention cease to apply. Consequently, with the engagement of the primary pawl 1 immediately the second pawl 2 and thus the blockade lever section 5 into the blockade position for blocking of the primary pawl 1 in the ratcheted state pivots with the catch 3 in the main ratchet position. In particular, blocking takes place externally crucially radially in the direction of the catch rotational axis 14.

For opening of the locking mechanism from the pre-ratchet or the main ratchet, only activation of the triggering lever 6 is necessary, preferably against the spring pre-tensioning of the secondary pawl 2.

If the triggering lever 6 is activated to detach the pre-ratchet, the secondary pawl 2 and thus the pre-ratchet contour 13 is pivoted away from the pre-ratchet contour 12 of the catching arm 8. Consequently, the catch 3 can pivot in the opening direction.

If the triggering lever 6 is activated to detach the main ratchet, the secondary pawl 2 and thus the blockade lever section 5 is pivoted out of the blockade position. Consequently, the primary pawl 1 can pivot out by means of the opening moment into the area of the free-lift recess 15. Consequently, the catch 3 can pivot in the opening direction. For normal loads, the gap 4 ensures that only the frictional force between the blockade lever section 5 and the primary pawl 1 needs to be overcome to trigger the locking mechanism with regard to the ratchet connections. The locking bolt 11 can thus leave the latch by means of the inlet slot 10 in the latch case 18.

In particular, the primary pawl 1 is formed lengthwise or crucially L-shaped and/or accommodated pivotably to the end opposite the main ratchet contour 16. In particular, the secondary pawl is L-shaped, whereby the in particular lengthwise and/or radial-leg of the L-shape preferably demonstrates the pre-ratchet contour 13 and/or the overload main ratchet contour 19 on the free radial end. In particular, the other crucially bent or tangentially formed L-leg of the L-shape in the circumferential direction is the blockade lever section 5. The radius of the external contour of the blockade lever section 5 is preferably between 20% and 70% of the radius of the free end of the radially extending L-leg of the L-shape.

The catch 3 is preferably arranged on the opposite side from the inlet slot 10 of the latch case 18, like the primary pawl 1 and the secondary pawl 2.

What is claimed is:

1. A latch for a door or flap of a motor vehicle, the door or flap is movable between an open position and a closed position, the latch comprising:

a locking mechanism including a catch, a primary pawl that engages the catch for ratcheting the catch when the catch is in a main ratchet position when the latch is in the closed position, and a separate secondary pawl that engages the catch for ratcheting the catch when the catch is in a pre-ratchet position prior to reaching the main ratchet position during closure of the latch from the open position toward the closed position, wherein during a normal load acting on the latch, the secondary pawl is disengaged from the catch when the catch is in the main ratchet position and the latch is in the closed position, wherein the normal load is defined by a force that acts on the catch when the catch is in the main ratchet position, the force acting in an opening direction of the catch which is a direction in which the catch moves out of the main ratchet position during opening of the latch from the closed position toward the open position, and wherein during an overload acting on the latch, the overload being a greater force that acts on the catch relative to the force during the normal load, at least one of the primary pawl and the catch are elastically deformed to enable engagement of the secondary pawl with the catch, wherein the secondary pawl and the primary pawl are both engaged with the catch when the catch is in the main ratchet position for distributing the overload to both the primary pawl and the secondary pawl.

2. The latch of claim 1 wherein during the normal load, a gap distances the secondary pawl from the catch in the opening direction of the catch when the catch is in the main ratchet position.

3. The latch of claim 2 wherein during the overload, a closure of the gap occurs.

4. The latch of claim 1 wherein the catch is movable in an opening direction whereby an opening moment is induced into the primary pawl and/or the secondary pawl has a blockade lever that engages the primary pawl to block the primary pawl in when the primary pawl is engaged with the catch when the catch is in the main ratchet position.

5. The latch of claim 4 further comprising a triggering lever of the locking mechanism that is configured to move the locking mechanism both from the pre-ratchet position and the main ratchet position to open the latch.

6. The latch of claim 1 wherein the catch, the primary pawl and the secondary pawl are arranged in a same rotational plane.

7. The latch of claim 4 wherein the blockade lever is provided by a blockade lever section of the secondary pawl.

8. The latch of claim 7 wherein if the catch rotates from an opening position in a direction of the main ratchet position, the secondary pawl is pivoted after the catch has passed the pre-ratchet position, whereby the blockade lever section enables blockade-free pivoting of the primary pawl to ratchet the catch in the main ratchet position.

9. The latch of claim 1 wherein only the secondary pawl ratchets the catch in the pre-ratchet position.

10. The latch of claim 1 wherein the primary pawl and the secondary pawl engage a same arm of the catch to ratchet the catch, wherein the same arm is either a load arm or a catching arm.

11. The latch of claim 1 wherein the primary pawl and the secondary pawl engage different arms of the catch to ratchet the catch, wherein the different arms include a load arm and a catching arm.

12. The latch of claim 11, wherein the primary pawl engages the load arm and the secondary pawl engages the catching arm.

13. A latch for a door or a flap of a motor vehicle, the door or flap is movable between an open position and a closed position, the latch comprising:

a locking mechanism including a catch with a load arm and a catching arm, a primary pawl that engages the load arm to ratchet the catch when the catch is in a main ratchet position when the latch is in the closed position, and a separate secondary pawl that engages the catching arm to ratchet the catch when the catch is in a pre-ratchet position prior to reaching the main ratchet position during closure of the latch from the open position toward the closed position, wherein the catch, the primary pawl and the secondary pawl are arranged in a same rotational plane, and wherein the primary pawl and the secondary pawl are separately engageable with the catch prior to an overload acting on the locking mechanism that is greater than a normal load, wherein the normal load is defined by a force that acts on the catch when the catch is in the main ratchet position, the force acting in an opening direction of the catch which is a direction in which the catch moves out of the main ratchet position during opening of the latch from the closed position toward the open position, wherein the overload is a greater force that acts on the catch relative to the force during the normal load, and wherein the primary pawl and the secondary pawl are simultaneously engageable with the catch after the overload.

* * * * *